US005723178A

United States Patent [19]

Sheets

[11] Patent Number: 5,723,178

[45] Date of Patent: Mar. 3, 1998

[54] METHOD FOR MAKING THERMOCHROMIC WRITING INSTRUMENTS USING TOPICALLY APPLIED THERMOCHROMIC PIGMENTS

[75] Inventor: Jeffrey D. Sheets, Wylie, Tex.

[73] Assignee: J.R. Moon Pencil Co., Inc., Lewisburg, Tenn.

[21] Appl. No.: 519,918

[22] Filed: Aug. 28, 1995

Related U.S. Application Data

[60] Provisional application No. 60/000,756 Jun. 30, 1995.

[51] Int. Cl.[6] ..... B05D 5/06; B05D 1/38

[52] U.S. Cl. ..... 427/258; 427/265; 427/287; 427/429; 427/430.1; 446/14

[58] Field of Search ..... 427/258, 260, 427/265, 282, 287, 421, 429, 430.1, 150; 118/407, 408, 419, 423; 446/14

[56] References Cited

U.S. PATENT DOCUMENTS

| | | | |
|---|---|---|---|
| 3,677,801 | 7/1972 | Hardy | 427/429 |
| 4,028,118 | 6/1977 | Nakasuji et al. | 106/21 |
| 4,045,383 | 8/1977 | Koff | 260/8 |
| 4,421,560 | 12/1983 | Kito et al. | 106/21 |
| 4,425,161 | 1/1984 | Shibahashi et al. | 106/21 |
| 5,194,183 | 3/1993 | Munch et al. | 252/586 |
| 5,376,699 | 12/1994 | Sage | 523/206 |
| 5,514,516 | 5/1996 | Vanmaele | 430/201 |

FOREIGN PATENT DOCUMENTS 201905 4/1994 European Pat. Off. .

*Primary Examiner*—Shrive Beck
*Assistant Examiner*—Fred J. Parker
*Attorney, Agent, or Firm*—Dowell & Dowell

[57] ABSTRACT

A method for making thermochromic writing instruments using topically applied thermochromic pigments includes the steps of: providing a water-based or solvent-based lacquer having a predetermined viscosity; dispersing a predetermined concentration of thermochromic pigment in the gasket lacquer; applying the resulting thermochromic lacquer to writing instruments; removing the excess thermochromic lacquer from the coated writing instruments; and curing the coated thermochromic writing instruments.

23 Claims, 2 Drawing Sheets

METHOD FOR MAKING THERMOCHROMIC WRITING INSTRUMENTS USING TOPICALLY APPLIED THERMOCHROMIC PIGMENTS

CROSS-REFERENCE FOR RELATED APPLICATION

This application is declaring benefit of a provisional application, U.S. Ser. No. 60/000,756, filed Jun. 30, 1995 by Jeffrey Sheets and entitled "Method for Making Thermochromic Writing Instruments Using Topically Applied Thermochromic Pigments," now abandoned.

TECHNICAL FIELD OF THE INVENTION

This invention relates generally to writing instruments, and more particularly to a method for making thermochromic writing instruments using topically applied thermochromic pigments.

BACKGROUND OF THE INVENTION

Historically, writing instruments such as pens and pencils have been manufactured in different colors and with different designs. These different colors and designs are typically painted or printed on the pens and pencils.

Another type of writing instrument available in the industry is a "wrapped" writing instrument. Wrapped pens and pencils include patterns that create interesting optical and illusionary effects. These wraps are sometimes called foil wraps because the pens and pencils are actually wrapped in printed foil.

Recently, thermochromic writing instruments have become available on a very limited basis. The term thermochromic generally refers to the chemical property of changing color based on heat. Thermochromic pens and pencils change color based on the application of heat to the pen or pencil, e.g., the heat from one's hand.

To date, production of thermochromic writing instruments using a topical application of thermochromic pigment has been unknown. As described more fully in a patent application entitled "Method for Making Liquid Crystal-Coated Thermochromic Writing Instruments" filed contemporaneously herewith, Applicant recently developed a novel process for manufacturing thermochromic pens and pencils using liquid crystals.

Applicant is aware of only one other manufacturer of thermochromic writing instruments. Bic Corporation manufactures thermochromic writing instruments using an injection molding process whose sole application is to pens.

While the above-described writing instruments have merit, there are disadvantages associated with each. For example, children often become bored with "plain" pens and pencils that can't "do" anything. Similarly, foil-wrapped writing instruments are less appealing than interactive, thermochromic writing instruments.

Underprinted writing instruments manufactured according to prior art methods have certain disadvantages. Prior art underprinted writing instruments are produced using application of film by a metal printing plate. A metal printing plate often creates small indentations or holes in the surface of the writing instruments during application of the film. Later, when the thermochromic pigment is applied, thermochromic pigment does not completely fill the previously created indentations. Air pockets develop in the indentations, which affect the durability and appearance of the final product.

Finally, thermochromic writing instruments made with injection molding are very slow to respond to the application of heat and can only change two colors. An injection molded thermochromic pen might require in excess of forty-five (45) seconds to react to the holder's body heat and change color. In addition, due to the injection molding manufacturing process, the thermochromic pigment must be microencapsulated with thick walls. The thick walls further retard the ability of the writing instrument to change the pigment color in response to applied heat. In addition, the pens manufactured with an injection molding process often have a dull or muted color that is less appealing to children.

Thus, there is a need for a cost-effective method for manufacturing thermochromic pens and pencils using a topical application of thermochromic pigment wherein the writing instruments change color very quickly in response to heat, while maintaining their original color brightness and durability.

SUMMARY OF THE INVENTION

The present invention comprises a method for making thermochromic writing instruments using topically applied thermochromic pigments that overcomes the disadvantages associated with the prior art methods and writing instruments. The method comprises the steps of: providing a water-based or solvent-based lacquer having a particular viscosity; dispersing a predetermined concentration of thermochromic pigment in the lacquer; applying the resulting thermochromic lacquer to writing instruments; and curing the coated thermochromic writing instruments.

BRIEF DESCRIPTION OF THE DRAWINGS

For a more complete understanding of the present invention and the advantages thereof, reference is now made to the following Detailed Description of the Invention, taken in conjunction with the accompanying Drawings in which.

DETAILED DESCRIPTION OF THE INVENTION

Figure 1:
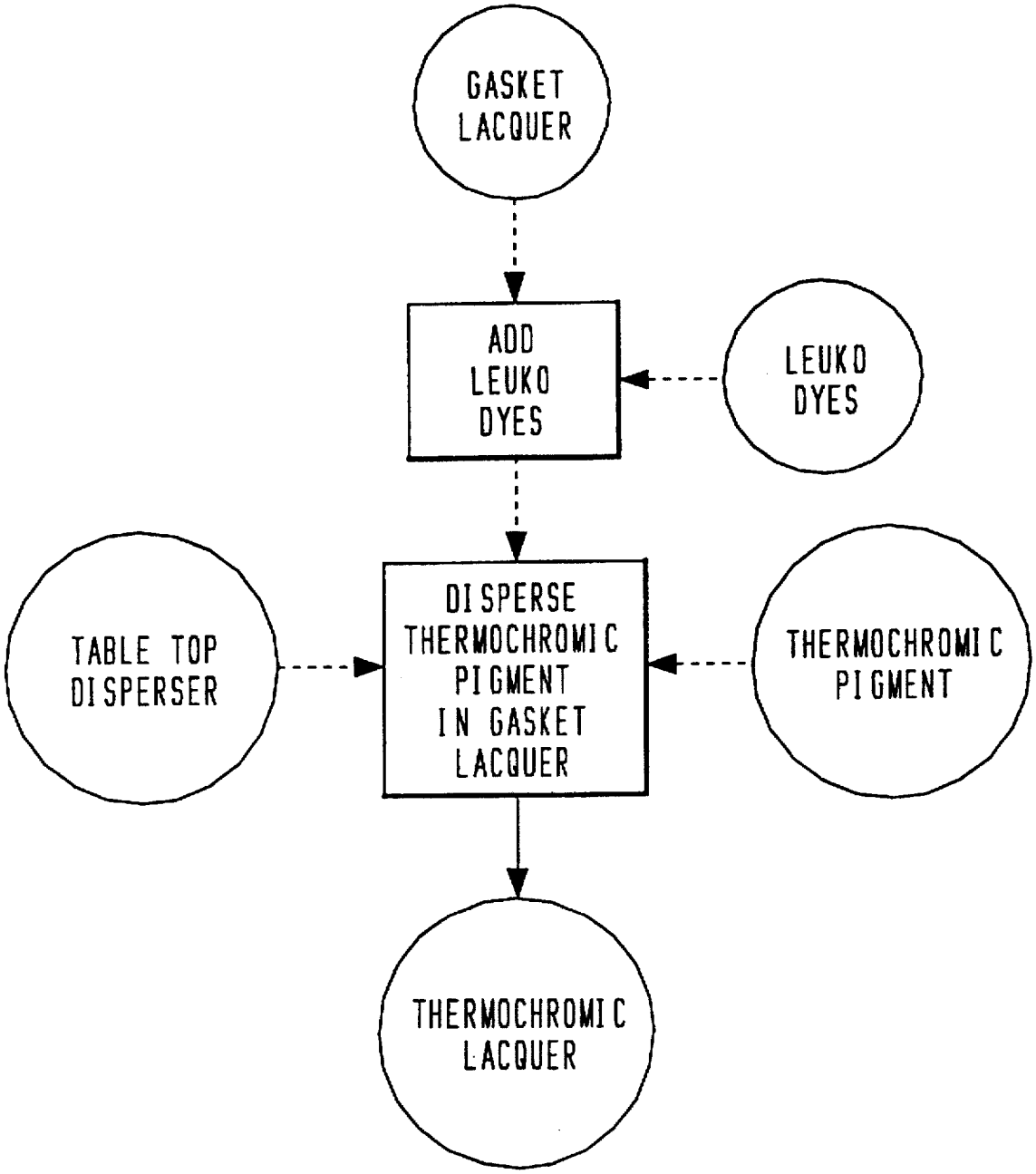
FIG. 1 is a flow chart illustrating the method for making thermochromic lacquer.

Referring now to the Drawings wherein like reference characters designate like or similar parts throughout the two views, FIG. 1 is a flow chart illustrating the method for making thermochromic lacquer.

Thermochromic refers to the chemical property of changing color based on heat. Thermochromic pigments have the ability to change between two independent color states. They can be active, where they do not reflect any light bands or wavelengths (clear state), or inactive, where they reflect a very specific band of light (colored state). For example, a clear ink with a blue thermochromic pigment dispersed in it will be blue in its inactive state and will become clear when heated to a state of activity.

It is possible to vary the temperature at which the color disappears. Such a color disappearance is called clearing. Thermochromic pigments clear in a temperature range of 5°–15° Celsius. They can be formulated to begin clearing at a temperature as low as –4° Celsius, and as high as 58° Celsius. For example, if a thermochromic pigment is formulated at 25° Celsius, it will begin clearing at 25° Celsius and will be totally clear between 30°–40° Celsius. It is this color clearing that makes it possible for a coating to appear to change color.

Using the above-described principles, the color change effect can be accomplished in two different ways: (1) by applying a clear coating with thermochromic pigments dispersed in it over an already colored surface; or (2) by dispersing leuko-dyes in a clear coating that has thermochromic pigments already dispersed in it, thereby creating a new color that returns to the original leuko-dye color when heated. Each method of creating the color change effect appears to be equally effective.

The method for making thermochromic writing instruments of the present invention utilizes multiple coating formulations (solvent-based or water-based) and multiple coming methods (gasket coating, dip coating or spray coating). The first step in the method for making thermochromic writing instruments is manufacturing the thermochromic coating or lacquer (FIG. 1). The thermochromic coating used in the method of the present invention may be water-based or solvent-based. Generally, solvent-based thermochromic coatings are preferred because they are more durable than water-based coatings and they require a shorter production cycle than water-based coatings. However, either type of thermochromic coating may be used in the method of the present invention.

A different formulation of thermochromic coating is required depending on the particular coating process selected. Accordingly, the steps to manufacture the thermochromic coating will be discussed first, followed by a discussion of the method for making thermochromic writing instruments using the thermochromic lacquer of the present invention.

The method of the present invention utilizes a lacquer in manufacturing the thermochromic coating. Generally, a lacquer is a resin dispersed in a carrier that may be used as a protective coating. Preferably, the lacquer of the present invention is nitrocellulose-based. Alternatively, an acrylic, urethane or similar lacquer may be substituted. The lacquer must have a particular viscosity, depending on the method selected. Specifically, the lacquer may be of high or low viscosity. In addition, the lacquer may be solvent or water-based.

The following steps are used to manufacture a solvent-based thermochromic coating for use in a gasket coating method for making thermochromic writing instruments. A gasket lacquer is required. The preferred method utilizes a nitrocellulose gasket lacquer. An acrylic, urethane or similar lacquer may be substituted for the nitrocellulose gasket lacquer, if desired. Any lacquer having a viscosity sufficiently high enough to allow it to work properly in a gasket or paint machine may be used in this method. For example, a gasket lacquer having a viscosity of 5,000–15,000 centipoise is adequate. A preferred gasket lacquer has a viscosity of 10,000 centipoise.

The gasket lacquer may be clear or colored with a leuko-dye, depending on which color change method is used. Leuko-dyes are generally available in the industry from any pigment supplier.

As illustrated in FIG. 1, a predetermined amount of solvent-based thermochromic pigment is dispersed in the gasket lacquer. Thermochromic pigment is available from a number of suppliers, including Matsui. The concentration by weight of the thermochromic pigment in the solvent-based gasket lacquer should be 5%–30%. The thermochromic lacquer is typically formulated in the temperature range of 20°–30° Celsius.

The thermochromic pigment may be dispersed in the gasket lacquer using a table-top disperser with a standard blending attachment. If desired, any similar device capable of thorough blending of the components may be substituted for the table-top disperser. The time required to disperse the thermochromic pigment in the gasket lacquer is approximately one to five minutes. The resulting thermochromic lacquer is now ready to be used to manufacture thermochromic writing instruments.

If a water-based thermochromic coating is desired, the same steps described above for a solvent-based thermochromic coating are used, with the following modifications. A high-viscosity, water-based gasket lacquer is required. In addition, the concentration of the thermochromic pigment in the gasket lacquer will be different. The concentration by weight of the thermochromic pigment in the water-based gasket lacquer should be 10%–40%, rather than the 5%–30% concentration used with the solvent-based gasket lacquer.

A different thermochromic coating formulation is used in the dip coating method for making thermochromic writing instruments. The dip coating method also requires a solvent- or water-based gasket lacquer (containing nitrocellulose) and thermochromic pigment. The gasket lacquer may be clear or colored with a leuko-dye, depending on the color change method to be used.

For a solvent-based thermochromic coating used in the dip coating method, the gasket lacquer must have a viscosity sufficiently low enough to permit run-off after dipping the writing instruments in the thermochromic coating. The required viscosity of the gasket lacquer is 10–30 seconds, using a #2 Zahn viscometer. If determining the concentration by weight of the thermochromic pigment in the gasket lacquer, the same % concentration described above in connection with the gasket coating method may be used.

The thermochromic pigment may be blended with the dip lacquer using a standard table-top disperser with a blending attachment or a similar device capable of thorough blending of the components.

If a water-based thermochromic coating is desired for use in the dip coating method, the same steps described above for a solvent-based thermochromic coating are used, with the following modifications. A low-viscosity, water-based dip lacquer is required. The dip lacquer must have a viscosity sufficiently low to permit run-off after dipping the writing instruments in the thermochromic coating. The required viscosity of the dip lacquer is 10–30 seconds, using a #2 Zahn viscometer. If de weight of the thermochromic pigment in the gasket lacquer, the same % concentration described above in connection with the gasket coating method may be used.

The same steps used to create a solvent-based or water-based thermochromic coating for use in the dip coating method may be used in the spray coating method. It may be necessary to modify the viscosity within the above-stated range to ensure proper atomization through the spray gun and thus provide a smoother coating. For example, the viscosity may be reduced by 1–2 seconds.

Figure 2:
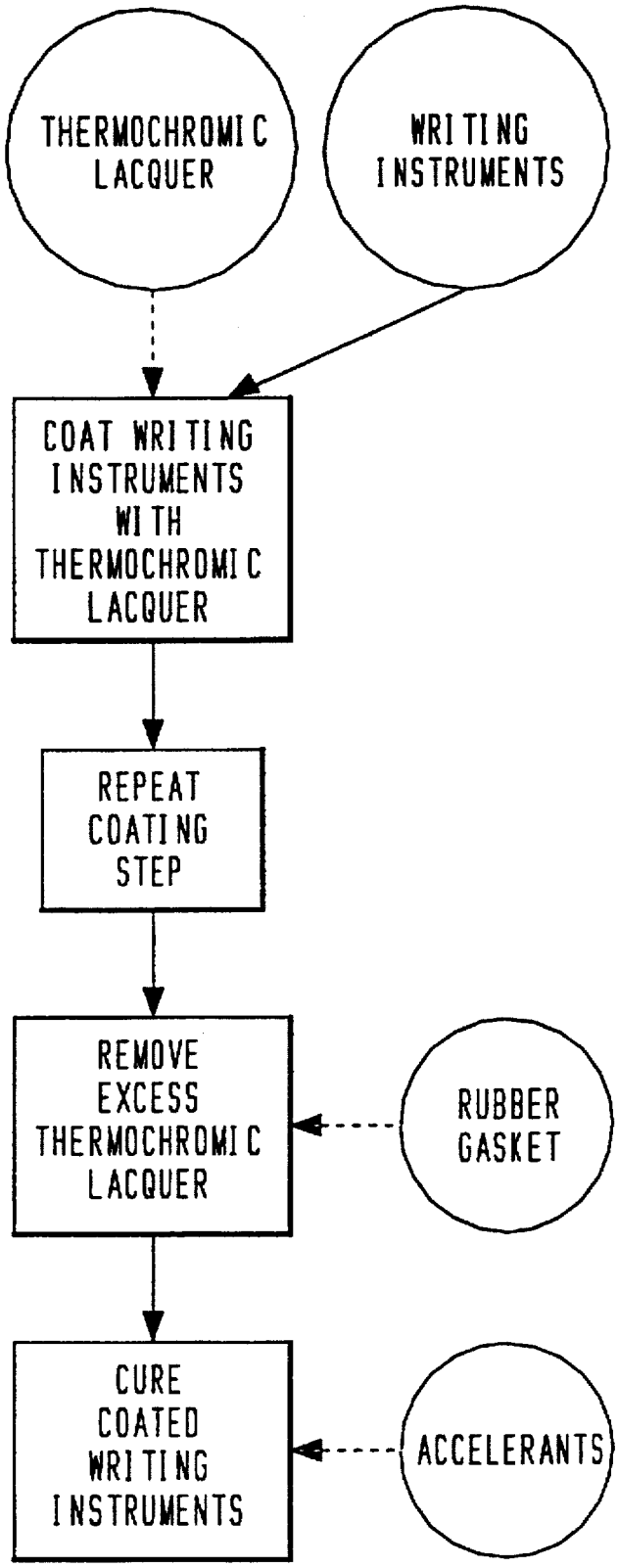
FIG. 2 is a flow chart illustrating the method for making thermochromic writing instruments using the thermochromic lacquer of FIG. 1.

After the solvent- or water-based thermochromic coating is prepared, the next step is to coat the writing instruments with the thermochromic lacquer (FIG. 2). Various coating methods may be used to produce thermochromic writing instruments according to the method of the present invention. The methods include the gasket coating, dip coating and spray coating methods. Each method may be used with water- or solvent-based coating formulations.

The gasket coating method is one method used to apply thermochromic lacquer to writing instruments such as pencils. The gasket coating method is used to both coat the writing instruments with the thermochromic lacquer and remove excess thermochromic lacquer from the writing instruments.

The gasket coating method employs a rubber gasket to remove excess lacquer previously applied to the writing instrument. Alternatively, some other suitable flexible, composite material may be substituted for the rubber gasket. The writing instruments are passed through a rubber gasket containing thermochromic lacquer. The step of applying and removing excess thermochromic lacquer is repeated multiple times until the thermochromic lacquer has achieved sufficient thickness on the writing instrument to provide the desired color and finish on the writing instrument.

Thermochromic pigments are larger in size than standard pigmented lacquers, i.e., generally 5–15 microns. Due to the larger micron size of the thermochromic pigment, a slightly larger gasket must be used to coat the writing instruments. The gasket used in the method of the present invention should be 0.005"–0.015" larger than the standard gasket used for a standard pencil size, as outlined by the Pencil Manufacturer's Association.

The number of cycles required to achieve a predetermined coating thickness of thermochromic lacquer on the writing instrument may vary depending on climatic conditions. Generally, three to four cycles are necessary to produce a thermochromic writing instrument with the desired characteristics. A writing instrument having a final thermochromic coating thickness of 0.5–5.0 mils is preferred.

In addition to having a thermochromic coating, writing instruments may be underprinted or overprinted, or include both types of printing. Underprinting involves printing or otherwise embedding markings such as words, text, logos, etc. on the uncoated writing instruments. Uncoated writing instruments may also be painted, rather than printed, prior to application of the thermochromic pigment. Underprinting involves a standard procedure known in the industry.

The underprinting process is generally known in the writing instrument industry and is commonly used in retail applications. Foil or some type of film is positioned on a printing plate. Film suitable for underprinting may be obtained from Webb-Tech, Robbinsville, N.J. The printing plate must be rubber, latex or a similar material, rather than metal. A rubber printing plate decreases and/or prevents creation of indentations in the uncoated writing instruments during the underprinting process. Uncoated writing instruments are placed on the rubber printing plates. The preselected foil or film markings are embedded in the surface of the uncoated writing instruments using application of pressure.

Thermochromic writing instruments may also be overprinted. This process involves printing or otherwise embedding markings on top of the thermochromically coated writing instruments. Typically, a standard screen printing method known in the industry is used for this step. Overprinting can range from completely covering the writing instrument, i.e., wrapping it, to selective placement of the markings on the writing instrument. Overprinting is common in specialty advertising applications.

If the writing instruments are printed prior to applying the thermochromic coating, the underprinting may be masked, if desired. If this step is included, the underprinted markings will be visible only when sufficient heat has been applied to the writing instrument to permit the thermochromic pigment to clear. The resulting writing instrument may be used in a game, or in connection with a novelty or learning function.

Opacity of the thermochromic pigment affects the masking process. During the masking process, one attempts to match the color of the underprinting or underpainting to the final color of the thermochromic pigment. If the underprinting color is lighter than the thermochromic pigment color, the underprinting color does not have to be the same color as the thermochromic pigment color. For example, a writing instrument might have gold underprinting overlain by black thermochromic pigment that clears to purple. In such a case, the underprinting color (gold) will be masked sufficiently by the darker, more opaque (black) thermochromic pigment until heat is applied to permit the thermochromic pigment to clear (to purple), and reveal the underprinting (gold) against the cleared thermochromic pigment (purple). Opacity of the thermochromic pigment is essential if the underprinting color and thermochromic pigment color are different.

If the writing instruments are overprinted, the color of the overprinting and the thermochromic pigment must match almost exactly. In the case of overprinting, blending and matching colors is essential, rather than opacity of the thermochromic pigment. Blending of the overprinting and thermochromic colors is important so that the overprinting will be visible only during clearing of the thermochromic pigment.

If leuko-dyes are added to the clear gasket lacquer with thermochromic pigments already dispersed in it, the coating applied to the writing instrument will be a blended thermochromic color that will change to the leuko-dye color when heated. A writing instrument manufactured according to the above-described method will change color when heat is applied thereto.

Following removal of excess thermochromic lacquer from the writing instruments, the coated writing instruments are permitted to dry. Preferably, the coated writing instruments dry for approximately 5–15 seconds. Drying time may vary, however.

Depending on the required production cycles, various conventions may be used to accelerate the curing process. For example, gentle air flow and moderate heat of 25°–35° Celsius may be applied to the coated writing instrument to accelerate the curing process.

The dip coating method is also used to manufacture thermochromic writing instruments. After the thermochromic lacquer is manufactured according to the present invention, the writing instruments are submerged in containers of water- or solvent-based thermochromic lacquer.

It is critical to monitor the insertion and withdrawal rates into and out of the thermochromic lacquer. The faster a writing instrument is inserted into the thermochromic lacquer, the less control one has in stopping at a specified point. In addition, faster insertion and withdrawal create more bubbles in the finish of the coated writing instrument. In the preferred method, the writing instruments are inserted into the thermochromic lacquer at a rate of 0.1–1.0 inches per second.

The withdrawal rate of the coated writing instrument from the thermochromic lacquer is even more important. The faster one withdraws a writing instrument from the thermochromic lacquer, the more coating will be applied to the writing instrument. Likewise, a slower withdrawal rate produces less thermochromic lacquer on the writing instrument. The preferred range for withdrawal from the thermochromic lacquer at the above-specified viscosity is 0.005–0.250 inches per second.

Adjusting the viscosity of the thermochromic lacquer and the withdrawal rate of the coated writing instruments affects the amount of coating applied to the writing instruments. These parameters may be adjusted to produce a final thermochromic coating thickness of 0.5–5.0 mils.

As described above in connection with the gasket coating method, the writing instruments may be underprinted, underpainted or coated using a blended leuko-dye/thermochromic lacquer prior to the step of coating the writing instruments with the thermochromic lacquer.

Writing instruments may also be spray painted using a thermochromic lacquer or blended leuko-dye/thermochromic lacquer. It is preferable to use a high volume, low pressure (HVLP) system with a fine-spray nozzle. A system such as the Binks Mach I HVLP system with pressure pots is adequate for this operation.

To coat the writing instruments using a high-volume, low-pressure system, it is necessary to use a predetermined amount of air pressure combined with a predetermined spraying technique. Air pressure should be 40–95 psi. The optimum spraying technique is a steady and even spraying motion until filming occurs. Using the above-described air pressure/spray technique, one may apply a thermochromic lacquer that will dry to a final thermochromic coating thickness of 0.5–5.0 mils. It should be noted that the spray coating method is more difficult to control than the gasket coating and dip coating methods because of the variability of individual spraying techniques.

The method for making thermochromic writing instruments of the present invention using the thermochromic lacquer of the present invention has numerous advantages over the prior art writing instruments and methods. For example, the method of the present invention may be used to manufacture pens and pencils. The method produces a more durable finish and a stronger, brighter color on the coated writing instrument than prior art methods.

In addition, the method produces a faster color change when the coated writing instrument is subjected to heat. For example, a thermochromic writing instrument made according to the method of the present invention will typically change color in change color in less than three (3) seconds following heating, as opposed to the more than forty-five (45) seconds requited to change color for coated writing instruments produced by injection molding methods.

Although preferred and alternative embodiments of the method of the present invention have been illustrated in the accompanying Drawings and described in the foregoing Detailed Description of the Invention, it will be understood that the invention is not limited to the embodiments disclosed, but is capable of numerous rearrangements, modifications, and substitutions of parts and elements without departing from the spirit of the invention.

I claim:

1. A method for making thermochromic writing implements using thermochromic pigments, using the steps of:

dispersing a thermochromic pigment in a lacquer to form a thermochromic lacquer of a type exhibiting a base color at a first temperature and which base color turns clear at a second temperature which is higher than said first temperature;

underpainting a surface of a writing implement by applying a paint of a color which is masked by the base color of the thermochromic lacquer thereon at the first temperature;

forming a coated writings implement by applying the thermochromic lacquer to the surface of the underpainted writing implement so as to form a thermochromic coating over the underpainting to thereby mask the paint at the first temperature; and curing the coated writing implement.

2. The method of claim 1 further including the step of adding leukodye to the thermochromic lacquer prior to forming a thermochromic coating over the underpainting paint.

3. The method of claim 1 including dispersing the thermochromic pigment in the lacquer until the concentration by weight of the thermochromic pigment is 5%–30%.

4. The method of claim 1 including dispersing the thermochromic pigment in the lacquer until the concentration by weight of the thermochromic pigment is 10%–40%.

5. The method of claim 1 wherein the thermochromic lacquer is applied to create a thermochromic coating thickness of 0.05–5.0 mils.

6. The method of claim 1 wherein the applying step further comprises the steps of immersing and withdrawing the underpainted writing implement into and out of a container of thermochromic lacquer.

7. The method of claim 6 wherein the underpainted writing implement is immersed into the thermochromic lacquer at a rate of 0.1–1.0" per second.

8. The method of claim 7 wherein the underpainted writing implement is withdrawn from the thermochromic lacquer at a rate of 0.05–0.250" per second.

9. The method of claim 1 wherein the thermochromic lacquer applying step comprises spraying the underpainted writing implement with thermochromic lacquer.

10. The method of claim 1 wherein the curing step comprises applying heat to the coated writing implement.

11. The method of claim 10 wherein heat is applied to the coated writing instruments at 25°–35° C.

12. The method of claim 6 wherein the underprinted writing implement is immersed into the thermochromic lacquer at a rate of 0.1–1.0" per second.

13. The method of claim 12 wherein the underprinted writing implement is withdrawn from the thermochromic lacquer at a rate of 0.05–0.250" per second.

14. The method of claim 1 wherein the thermochromic lacquer coating step comprises passing the underprinted writing implement through a gasket containing the thermochromic lacquer.

15. A method for making thermochromic writing implements using thermochromic pigments, using the steps of:

dispersing a thermochromic pigment in a lacquer to form a thermochromic lacquer of a type exhibiting a base color at a first temperature and which base color turns clear at a second temperature which is higher than said first temperature;

underprinting a surface of a writing implement by applying a paint of a color which is masked by the base color of the thermochromic lacquer thereon at the first temperature;

forming a coated writing implement by applying the thermochromic lacquer to the surface of the underprinted writing implement so as to form a thermochromic coating over the underprinting to thereby mask the paint at the first temperature; and curing the coated writing implement.

16. The method of claim 15 wherein the underprinting step comprises the steps of applying a film to a rubber printing plate and thereafter placing the underprinted writing implement on the rubber printing plate and applying pressure to transfer the film onto the surface of the underprinted writing implement.

17. The method of claim 15 further including the step of adding leukodye to the thermochromic lacquer prior to forming a thermochromic coating over the underprinting.

18. The method of claim 15 including dispersing the thermochromic pigment in the lacquer until the concentration by weight of the thermochromic pigment is 5%–40%.

19. The method of claim 15 wherein the thermochromic lacquer is applied to create a thermochromic coating thickness of 0.5–5.0 mils.

20. The method of claim 15 wherein the coating step further comprises the steps of immersing and withdrawing underprinted the writing implement into and out of a container of thermochromic lacquer.

21. The method of claim 15 wherein the thermochromic lacquer applying step comprises spraying the underprinted writing implement with thermochromic lacquer.

22. The method of claim 15 wherein the curing step comprises applying heat to the coated writing implement.

23. The method of claim 15 wherein the thermochromic lacquer applying step comprises passing the underprinted writing implement through a gasket containing the thermochromic lacquer.

* * * * *